US006591947B2

(12) United States Patent
Horbrügger et al.

(10) Patent No.: US 6,591,947 B2
(45) Date of Patent: Jul. 15, 2003

(54) USE OF MULTI-STATE SENSORS

(75) Inventors: Herbert Horbrügger, Berlin (DE); Peter Herkel, Berlin (DE); Stefan Spannhake, Berlin (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/139,055

(22) Filed: May 2, 2002

(65) Prior Publication Data

US 2002/0166732 A1 Nov. 14, 2002

(30) Foreign Application Priority Data

May 8, 2001 (DE) ..... 101 22 204

(51) Int. Cl.[7] ..... B66B 1/34

(52) U.S. Cl. ..... 187/393; 187/247; 187/316; 198/323

(58) Field of Search ..... 187/391, 316, 187/392, 393, 395, 247; 361/59, 71, 72, 74; 324/332, 333, 345; 73/862.041, 862.27, 862.51; 340/3.43, 3.44, 286.08, 292; 702/116; 198/322, 323, 330, 341.01, 502.1, 577

(56) References Cited

U.S. PATENT DOCUMENTS

| | | | | | |
|---|---|---|---|---|---|
| 4,750,591 | A | * | 6/1988 | Coste et al. | 187/391 |
| 4,898,263 | A | * | 2/1990 | Manske et al. | 187/247 |
| 5,443,142 | A | * | 8/1995 | Glaser | 187/316 |
| 5,760,350 | A | * | 6/1998 | Pepin et al. | 187/316 |
| 5,780,787 | A | * | 7/1998 | Kamani et al. | 187/316 |
| 5,791,440 | A | * | 8/1998 | Lonzinski et al. | 187/223 |
| 5,817,994 | A | * | 10/1998 | Fried et al. | 187/391 |
| 6,056,088 | A | * | 5/2000 | Gerstenkorn | 187/390 |
| 6,173,814 | B1 | * | 1/2001 | Herkel et al. | 187/288 |
| 6,193,019 | B1 | * | 2/2001 | Sirigu et al. | 187/391 |
| 6,467,585 | B1 | * | 10/2002 | Gozzo et al. | 187/391 |
| 6,484,125 | B1 | * | 11/2002 | Huang et al. | 702/183 |
| 2002/0117358 | A1 | * | 8/2002 | Schoppa et al. | 187/391 |

FOREIGN PATENT DOCUMENTS

| | | |
|---|---|---|
| DE | 1 081 636 | 5/1960 |
| DE | 1406215 | 1/1969 |
| DE | 41 11 297 C1 | 6/1992 |
| DE | 197 52 362 A1 | 6/1999 |
| EP | 0 780 336 A2 | 6/1997 |
| GB | 2 353 361 | 2/2001 |
| WO | WO 01/28912 A1 | 4/2001 |

* cited by examiner

*Primary Examiner*—Jonathan Salata

(57) ABSTRACT

Transport system (2), comprising a controller, a drive motor and a safety switch (18) that is connected to a safety-related part (8, 10) of the transport system (2) and is able to distinguish between a safe state of the transport system (2) and an unsafe state of the transport system (2), where the safety switch is connected to the controller in order to interrupt the power to the drive motor in an unsafe state, characterized by the fact that the safety switch (18) is realized so that it is able to also detect a warning state in addition to the safe state and the unsafe state.

7 Claims, 2 Drawing Sheets

USE OF MULTI-STATE SENSORS

FIELD OF THE INVENTION

The invention pertains to a transport system, in particular, a passenger transport system, such as an elevator, a moving sidewalk, or an escalator, where said transport system is provided with a controller, a drive motor, and a safety switch that is able to distinguish between a safe state of the transport system and an unsafe state of the transport system and that is connected to the controller in order to interrupt the power supply to the drive motor in the unsafe state.

BACKGROUND OF THE INVENTION

Transport systems of this type are broadly utilized in the form of elevators, as well as in the form of escalators and moving sidewalks. The safety switch serves for monitoring safety-related states of the corresponding transport system. In elevator systems, for example, the elevator shaft doors and, if applicable, the elevator car doors are continuously monitored. When one of the doors is opened, the controller interrupts the power to the drive motor until the door, and thus the safety switch, are correctly closed again and power to the drive motor is restored. The doors of elevator systems require considerable maintenance. For example, the elevator shaft doors are typically suspended from suspension mechanisms on which rollers are mounted in corresponding guide rails, which are accommodated in the lintel beam over the shaft door opening. The door may comprise one or more door panels. There are door designs with centrally opening shaft doors and laterally opening shaft doors, as well as those in which several door panels open and close in telescoping fashion in only one direction. The drive of the shaft doors is realized, e.g., by means of a drive cable or drive belt that is also arranged in the lintel beam over the shaft door opening. The shaft doors must be correctly adjusted in order to ensure the reliable opening and closing of the doors. Elevator car doors are similarly arranged on elevator cars.

Currently, two-part safety contacts are used in elevator doors, where one part contains two openings that lie closely adjacent and the other part essentially consists of a U-shaped metal profile, which, when the door is correctly closed, protrudes into the two openings of the other part and closes the contact between two electrical connections therein. Here, the two parts of the safety switch are arranged on door panels that open and close relative to one another, particularly in a region above the lintel.

Alternatively, one part of the safety contact is arranged on an opening door panel in laterally opening doors, where the other part is arranged, for example, on the door frame or the door frame soffit. The door switch is adjusted in such a way that the contact is closed when the door is correctly closed. The door switch requires adjustments in order to ensure that the contact is no longer closed once there exist a certain gap, for example, between the two door panels. When this condition occurs, the power to the drive motor is interrupted and operation of the elevator system can only resume if the elevator doors are readjusted and correctly close again.

The customary wear associated with the operation as well as the use of force on the elevator door, e.g., due to forcefully opening the door, etc., causes the door no longer correctly to close. In both instances, the incorrectly or unsafely closed condition does not occur from one instant to the next, but the transition from a correctly to an incorrectly closed condition takes place gradually. Conventional safety switches are unable to detect this gradual deterioration. The safety switch is only able to detect such deterioration once a certain wear or misalignment condition appears. In such circumstances, the elevator system is deactivated from one instant to the next. Such sudden shutdowns of elevator systems are undesirable for several reasons. First, the operators of elevator systems are always unhappy if the elevator system suddenly shuts down and maintenance must be called to restore service. Second, high expenditures with respect to personnel and logistics are needed to ensure that those elevator systems requiring service can be repaired around the clock.

The situation is quite similar with respect to escalators or moving sidewalks. These passenger transport systems typically contain a so-called step band that consists of a series of interconnected step elements, i.e., stairstep or pallet elements, which are moved from an entry point to an exit point by a drive motor. So-called bottom paneling is provided to the side of the step elements or pallet elements. The gap between the step elements and the bottom paneling must be maintained within a relatively narrow range for safety reasons. This is usually also monitored with corresponding safety switches. These safety switches typically trigger when the gap is exceeded and cause the escalator or moving sidewalk to be deactivated in such cases. In principle, the negative effects of these undesirable shutdowns are identical to those described above with reference to elevator systems.

SUMMARY OF THE INVENTION

The present invention is based on the objective of making available transport systems of the initially mentioned type which fulfill the corresponding safety requirements and significantly minimize the risk of a sudden shutdown when an unsafe state is detected.

According to the invention, this objective is realized in that the safety switch is effected so that it is able also to detect a warning state in addition to the safe and unsafe states.

The invention makes it possible to detect a warning state before an unsafe state is reached. Consequently, it is possible to indicate this warning state via the safety control. A corresponding warning message may be directly sent to maintenance, e.g., via a remote line. An arbitrary display device may alternatively or additionally inform the building's elevator attendant who then contacts maintenance. The transport system may be adjusted in such a way that, during typical operation, the warning state is indicated, for example, at least fourteen days before an unsafe state occurs. This means that sufficient time remains for readjusting the system or exchanging the defective parts during planned maintenance procedures. It would also be possible to realize the safety switch such that it continuously indicates the state of wear of the system instead of merely indicating a warning state once a certain intermediate state is reached.

Naturally, it is also possible to detect several intermediate states that essentially correspond to different warning levels. The safety switch preferably consists of a proximity switch, where an inductive proximity switch is particularly preferred. Alternatively, capacitive switches or devices may be used which, for example, determine the relevant spacing between two parts with the aid of light, ultrasound, etc.

Generally speaking, safety switches that cannot be manipulated are particularly preferred. For example, simple distance measuring devices that operate with ultrasound or light have the disadvantage that a closed door can be simulated with a mirror or another object. This is the reason why inductive proximity switches, particularly those composed of two parts are provided. In this case, the "passive part" preferably consists of a magnetic material, e.g., ferrite, with a certain magnetic field strength, to which the sensor part is "calibrated." This type of switch design is difficult to manipulate with any given magnet. This feature is particularly important because elevator surfers increasingly attempt to bypass the safety devices in elevator systems in order to ride on the roof of the elevator car.

The safety switch is preferably realized in such a way that it outputs a certain non-zero value of the output variable, e.g., the voltage, the current, the resistance, etc. When using a switch that does not deliver three discrete values, but rather is able to generate individual or continuous intermediate values, a continuous range of values which should not include zero is correspondingly output as the output signal. A switch of this type which, in its normal mode, only outputs signals that have a certain predetermined value that differs from zero or signals that lie within a certain defined range of values also makes it possible to realize a plausibility check. For example, when a switch in which the voltage is used as the output variable delivers an output signal of 0 V to the controller, it can be assumed that a switch defect has occurred or that the cable connection between the switch and the controller is interrupted. Depending on the type of switch, a voltage that is significantly higher than the usual output voltage of the switch may, for example, indicate a short circuit in the switch and consequently a switch failure. This makes it possible significantly to improve the operational reliability of the system.

The controller is preferably realized such that it processes the signal of the safety switch and interrupts the power to the drive motor if an unsafe condition is detected, where the controller does not interrupt the power but generates a warning signal if an intermediate state between completely safe and unsafe is detected, where the controller does not interrupt the power and does not generate a warning signal if a safe state is detected, and where the controller determines that the safety switch is not functional and thusly interrupts the power if a voltage value is detected which does not correspond to any of the predetermined voltage values of the safety switch. A value that does not correspond to any of the predetermined values of the safety switch occurs, for example, if no signal arrives at the controller or if values that are significantly higher than the predetermined output values arrive at the controller. The controller may be correspondingly realized in the form of a hardware circuit. Alternatively, it would also be possible to realize the controller with a microprocessor in which a corresponding algorithm in the form of a data processing program is stored. This program continuously requests values to be delivered by the safety switch(es) within certain intervals.

The present invention may be utilized in connection with conventional safety chains, for example, in elevator systems. In such safety chains, the individual shaft door contacts are typically connected in series, where the power to the drive motor is interrupted if any of the shaft door contacts is opened. In this safety chain, the so-called shaft pit emergency shutdown switch and the inspection switch are arranged on the roof of the elevator car. In a series circuit of this type, it is advantageous to realize the safety switch such that an intermediate state can also be assumed by the switch at a certain predetermined resistance in addition to the open state of the switch in which the resistance is essentially infinite and the closed state of the switch in which the resistance is essentially zero. This means that the system controller receives a correspondingly reduced voltage that can be defined as a warning state. Alternatively, it would be possible to forward the warning states to the controller other than through the safety chain, i.e., through separate connections to the controller.

Generally speaking, it is particularly preferred to use the present invention in connection with modern safety systems in which the status of the various safety switches is queried individually and the status messages of the safety switches are separately forwarded to the elevator controller. One example of an elevator safety system of this type in which a bus system is used to forward the data is described in U.S. Pat. No. 6,173,814 B1.

The transport system preferably consists of an elevator, and the safety switch preferably consists of a door contact switch that detects the closed state of the door.

The transport system preferably consists of an escalator or a moving sidewalk with a driven step band and a bottom paneling, where the safety switch monitors the gap between the step band and the bottom paneling.

BRIEF DESCRIPTION OF THE DRAWINGS

The invention and variations thereof are described in greater detail below with reference to an embodiment; the drawing shows.

DETAILED DESCRIPTION OF THE PREFERRED EMBODIMENT

Figure 1:
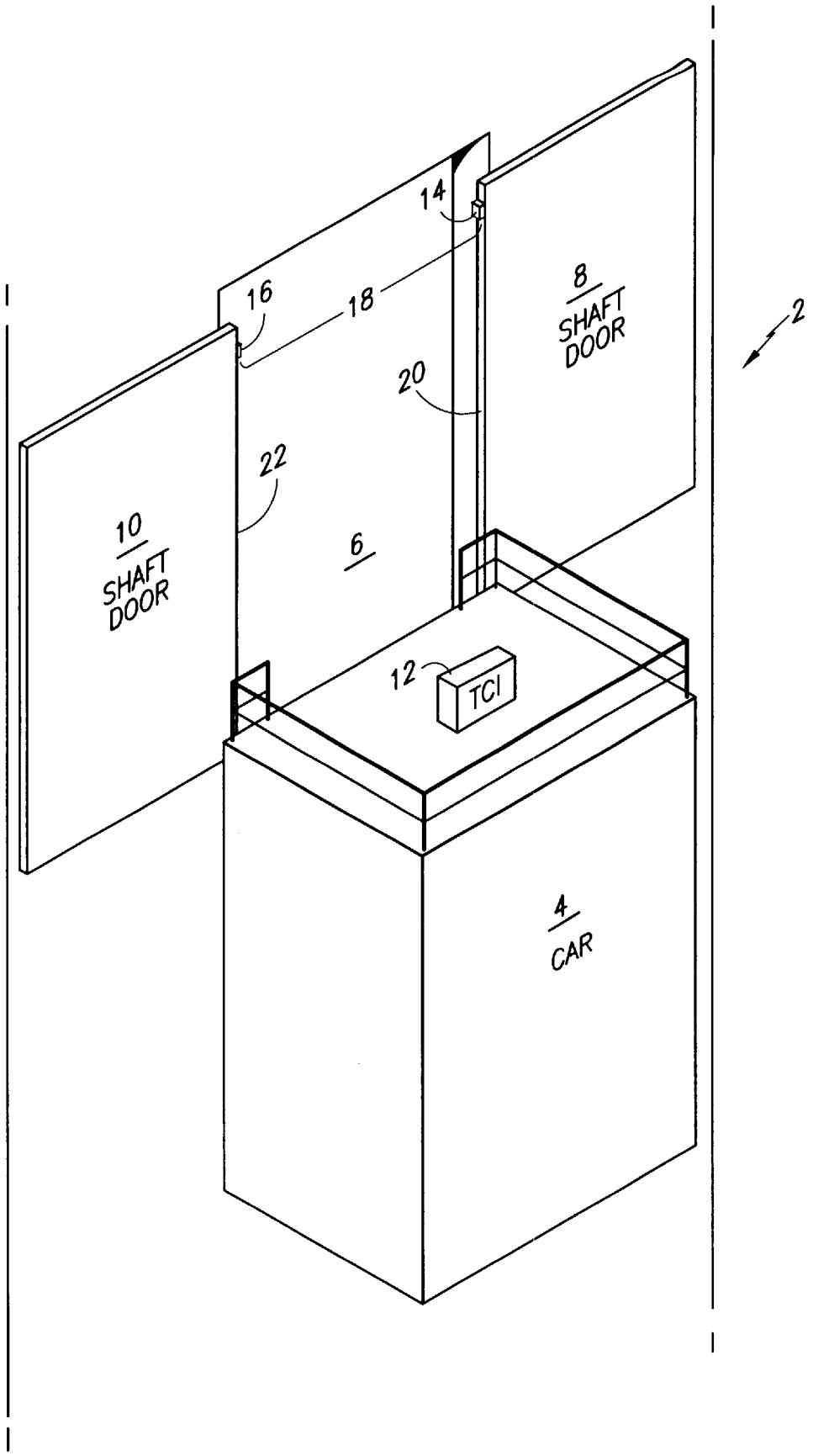
FIG. 1, part of an elevator system according to the invention.

FIG. 1 shows part of a transport system 2, namely the essential elements of an elevator system, in particular, an elevator car 4, a shaft door opening 6 and a shaft door that is composed of two door panels 8 and 10. When the door panels 8 and 10 are opened, the elevator car 4 is situated slightly underneath the shaft door opening 6. An inspection safety switch TCI 12 (TCI=Top of Car Inspection) that is connected to the (not-shown) elevator controller via a (not-shown) connection is arranged on the roof of the elevator car 4.

A first part 14 and a second part 16 of a safety switch 18, both of which are also connected to the elevator control, are arranged in the region of the end surfaces of the door panels 8 and 10. A suitable safety switch 18 was developed by the firm Bernstein AG, Germany.

The elevator car 4 may also contain an elevator car door that is provided with a safety switch 18.

The door panels 8 and 10 are mounted on the shaft wall by means of (not-shown) suspension mechanisms in such a way that they can be relatively displaced. In the closed state, the two end surfaces 20 and 22 of the door panels 8 and 10 essentially adjoin one another if the door panels 8 and 10 are correctly adjusted on the suspension mechanisms. However, this adjustment usually deteriorates over time due to wear or mechanical influences such that the gap along the end surfaces 20 and 22 either is no longer uniform or becomes excessively wide. Once the gap exceeds the permissible maximum value, the system is deactivated. This maximum value is detected by the safety switch 18. The safety switch 18 is also able to detect a gap that still lies below this maximum value, but already indicates a maladjustment to be corrected. It should be noted that a continuous warning signal is not generated from one instant to the next. On the contrary, certain indicators can already be detected during the operation. For example, the door panels 8 and 10 are moved relative to one another due to wind pressure while the elevator is in motion in the elevator shaft. This usually causes a "flickering" warning signal to already be generated quite some time before the continuous warning signal, wherein the flickering warning signal can already be correspondingly processed before it reaches the elevator control.

Figure 2:
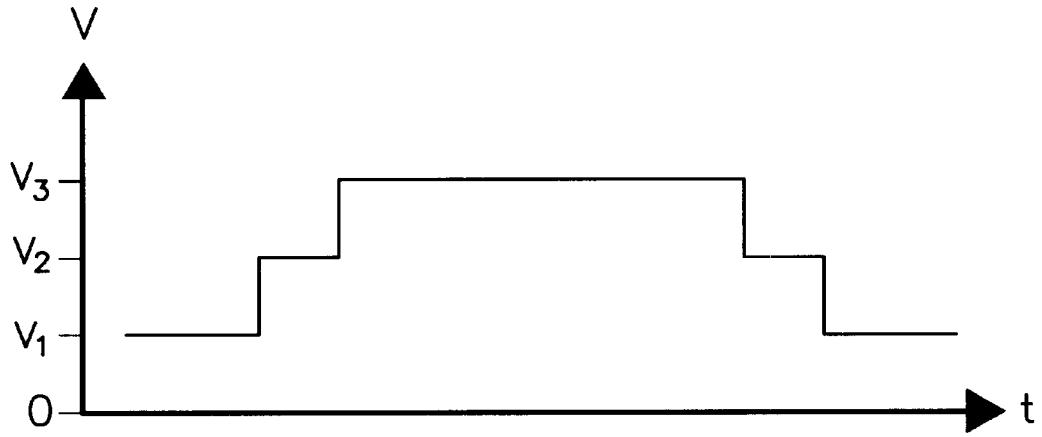
FIG. 2, by way of example, output signals of a safety switch in a flawlessly closing elevator door, and FIG. 3, output signals of a safety switch in a maladjusted elevator door that still, however, closes safely.
Figure 3:
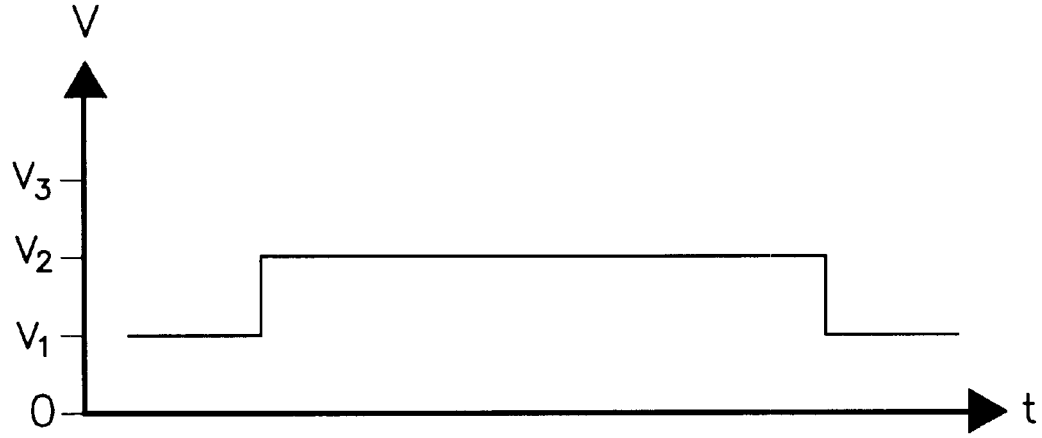

FIG. 2 shows the signal waveform of a door contact switch when the adjustment of the elevator door is still sufficiently correct. In FIG. 2 and FIG. 3, the output signal of the safety switch 18 is plotted in the form of a voltage V as a function of time t. Similarly, it would be possible to use a safety switch 18 in which the current or resistance, etc., represents the characteristic output variable. Specifically three discrete voltage values $V_1$, $V_2$ and $V_3$, can be seen. In this case, $V_1$ stands for the state in which the door is open, $V_2$ for the state in which the door, although safely closed, is misaligned to a certain extent, and $V_3$ for a sufficiently adjusted door.

If one follows the signal waveform along the time axis from left to right in FIG. 2, the signal waveform begins at $V_1$, where the door is open and continues to the completely closed state $V_3$, where the door is sufficiently adjusted, via the state $V_2$, where the door is closed. The state $V_1$ is an unsafe state, i.e., the power to the (not-shown) drive motor is interrupted by the controller in this state. The states $V_2$ and $V_3$ are considered safe states, i.e., the power to the drive motor is ensured in these states.

FIG. 3 shows a corresponding signal waveform for an elevator door that, although it still closes into a safe state, already requires adjustments. In this case, a warning signal is generated by the safety switch 18. Specifically, it can be seen to that the state $V_3$ is not reached even if the door is completely closed.

What is claimed is:

1. Transport system (2), including a drive motor, a controller for controlling the drive motor, and a safety-related part (8, 10) for sensing an unsafe condition in the transport system comprising:

a safety switch in communication with the controller and safety related part, the safety switch comprising a first output signal indicating a normal operating state, a second output signal indicating a need for maintenance of the safety related part, and a third output signal indicating an unsafe state.

2. Transport system (2) according to claim 1, the safety switch (18) comprising a proximity switch.

3. Transport system (2) according to claim 2, the safety switch (18) comprising an inductive proximity switch.

4. Transport system (2) according to one of claim 1, the first, second, and third output signals comprising a corresponding first, second, and third non-zero voltage.

5. Transport system (2) according to claim 1, the controller comprising:

a first signal for providing power to the drive motor upon detection of the first output;

a second signal for providing an indication of a need for maintenance upon detection of the second output; and a third controller output for interrupting the power to the drive motor upon detection of the third output, or upon detection of an output other than a first, second, or third output.

6. The transport system of claim 1 wherein the transport system is an elevator car having a door, the safety switch comprising a door contact switch that detects the closed state of the door (8; 10).

7. The transport system (2) of claim 1 wherein the transport system (2) is an escalator or a moving sidewalk with a driven step band and a bottom paneling, the safety switch comprising a switch for monitoring the gap between the step band and the bottom paneling.

* * * * *